US007841057B2

(12) United States Patent
Abrigo et al.

(10) Patent No.: US 7,841,057 B2
(45) Date of Patent: Nov. 30, 2010

(54) METHOD OF MANUFACTURING A PANEL FOR A MATTRESS

(75) Inventors: Luciano Abrigo, Alessandria (IT); Renzo Villa, Cassano d'Adda (IT); Bruno Macció, Masone (IT)

(73) Assignee: SAPSA Bedding SRL, Assago (IT)

( * ) Notice: Subject to any disclaimer, the term of this patent is extended or adjusted under 35 U.S.C. 154(b) by 135 days.

(21) Appl. No.: 12/059,476

(22) Filed: Mar. 31, 2008

(65) Prior Publication Data

US 2008/0271252 A1 Nov. 6, 2008

(30) Foreign Application Priority Data

May 4, 2007 (IT) ..... MI2007A0885

(51) Int. Cl.
*B68G 7/00* (2006.01)

(52) U.S. Cl. ..... 29/91.1; 5/690; 5/727; 5/730; 5/731; 112/2.1; 112/129; 112/132

(58) Field of Classification Search ..... 29/91.1; 5/690, 697, 740, 731, 730, 727, 724; 112/2.1, 112/129, 132, 262.3
See application file for complete search history.

(56) References Cited

U.S. PATENT DOCUMENTS 2,638,156 A * 5/1953 Berman ..... 267/145
2,994,890 A * 8/1961 Wagner ..... 5/718
3,594,045 A * 7/1971 Pannier et al. ..... 300/21
3,682,739 A * 8/1972 Tesch et al. ..... 156/293
4,042,986 A * 8/1977 Goodman et al. ..... 5/500
4,700,447 A * 10/1987 Spann ..... 29/418
4,777,681 A * 10/1988 Luck et al. ..... 5/655.9
4,901,387 A * 2/1990 Luke ..... 5/730
5,031,261 A * 7/1991 Fenner, Sr. ..... 5/736
D323,092 S * 1/1992 Fenner, Sr. ..... D6/596
5,107,558 A * 4/1992 Luck ..... 5/727
5,178,811 A * 1/1993 Farley ..... 264/138
5,249,322 A * 10/1993 Seago ..... 5/499
5,355,816 A * 10/1994 Echevarria ..... 112/2.1

(Continued)

FOREIGN PATENT DOCUMENTS

DE 88 13 141.6 U1 9/2008

(Continued)

OTHER PUBLICATIONS

Nov. 18, 2009, Communication issued in corresponding European Patent Application No. 07022248.4 by the European Patent Office with allowed claims.

*Primary Examiner*—Rick K Chang
(74) *Attorney, Agent, or Firm*—Novak Druce + Quigg LLP

(57) ABSTRACT

A panel for a mattress including first and second fabric layers joined together along their edges and a padding material between said fabrics. The padding material includes at least a layer of resilient foam provided with through-holes. The foam layer is quilted between the first and second fabric layers. A method of manufacturing the panel includes forming a resilient foam body provided with recesses, horizontally cutting a plurality of single layers in the body in the recesses portion to result in at least one layer with through-holes, sandwiching at least one of the single layers provided with through-holes in each panel between the first and second fabric layers.

19 Claims, 4 Drawing Sheets

U.S. PATENT DOCUMENTS

| | | | | |
|---|---|---|---|---|
| 5,430,901 | A * | 7/1995 | Farley | 5/730 |
| 5,461,737 | A | 10/1995 | Ikeda et al. | |
| 5,477,573 | A * | 12/1995 | Bonaddio et al. | 5/736 |
| 5,560,057 | A * | 10/1996 | Madsen et al. | 5/715 |
| 6,263,532 | B1 * | 7/2001 | Miller | 5/690 |
| 7,191,480 | B2 * | 3/2007 | Romano et al. | 5/690 |
| 7,426,767 | B2 * | 9/2008 | Mossbeck | 5/736 |
| 2002/0015817 | A1 | 2/2002 | Lieblein | |

FOREIGN PATENT DOCUMENTS

| | | |
|---|---|---|
| EP | 0 611 538 A1 | 8/1994 |
| EP | 1 400 191 A2 | 3/2004 |
| GB | 949 596 | 2/1964 |
| WO | 01 34356 A1 | 5/2001 |

* cited by examiner 16
42
17
45
46
48
47
21
15
D
A
C
B
53
49
50
52
20
19
43
23

2
19
3
25
43
51

26
19
3
43
51

10
9
9
10
10
9

METHOD OF MANUFACTURING A PANEL FOR A MATTRESS

FIELD OF THE INVENTION

The present invention relates to a mattress comprising at least one quilted panel and manufacturing method thereof.

BACKGROUND

For a better understanding of the invention, the elements and terms herein used are now set forth.

As it is well known, a mattress mainly includes a body, generally rectangular in shape, sandwiched between a covering consisting of an upper and a lower panel seamed together by stitching a peripheral band.

Each panel includes two fabrics with a padding material in between, herein after called "padding".

The padding is integral with the two fabrics by means of stitching operations called quilting, from which the term "quilted panel" originates.

Between two quilted portions such panels may be 2-8 cm. thick.

The mattress body may be made of different materials and in a number of configurations, for example, making use of a set of springs, some inflatable members or a block of cellular resilient material, such as a resilient foam provided with recesses, for example natural or synthetic latex foam.

U.S. Pat. No. 5,488,746 describes a mattress including a polyurethane foam body sandwichable between two quilted panels joined together by a peripheral band extending only on three sides, the fourth side being provided with a zip to allow the polyurethane foam body to be inserted and pulled out.

The body includes tapered openings obtained by means of a cutting device provided with rollers rotating each in an opposite direction and with a cutting blade.

Each panel is made as stated above.

The padding material of each panel consists of polyester cotton batting joined to the two panel fabrics by means of a suitable localized quilting.

In a cross section, the panel is a double wave with juxtaposed folds due to the stitching of the two fabrics.

It should be noted that, besides being comfortable for the user, a mattress should ensure, through a quick passage of the air, the evaporation of moisture collected during the user's sleep.

In fact, sweat absorbed by the mattress materials is believed to reach 0.3-0.8 litre per night.

Generally air can easily pass through the mattress body, as it is apparent, for sake of simplicity, when thinking of a spring mattress; however such favourable passing-through of the air completely depends on the resistance the air encounters when going through the quilted panels.

The prior art quilted panels may include, as seen, polyester cotton batting or in other embodiments, curled hair, wool and synthetic carded fibres, cotton fibres, coir or a combination thereof and also other materials known on the market.

Unfortunately the approaches known are not satisfactory as for transpiration.

Generally the prior art quilted panel presses under the user's weight packing the material which results in poor aeration of the mattress and in keeping most of the moisture collected during the night.

The goal of the present invention is to provide a mattress including at least one quilted panel, preferably the one the user lies on, whose padding material is able to improve the mattress transpiration as a whole.

SUMMARY OF THE INVENTION

A first object of the present invention is therefore to provide a panel for a mattress comprising first and second fabric layers joined together along their edges and a padding material between said two fabrics, characterized in that said padding material comprises at least a layer of resilient foam provided with through-holes, said layer of resilient foam being quilted between said first and second fabric layers.

Preferably the ratio between the thickness of the resilient foam layer with through-holes and the total thickness of the fabric layers ranges from 0.5 to 1. Suitably the resilient foam layer provided with through-holes is a polyurethane foam or even more preferably a latex foam, preferentially of uniform thickness all over. Said through-holes in the resilient foam layer can be made in a number of ways, for example, by punching the resilient foam layer. Advantageously the resilient foam layer has 6 to 84 through-holes/$dm^2$ and typically the resilient foam of the layer includes through-holes with a diameter of 1 to 3 mm and more preferably between 8 and 24 mm. Preferentially said layer of latex foam with through holes is cut as single layer in a moulded cellular latex foam body with recesses.

It is a second object of the present invention to provide a mattress including a body sandwiched between an upper and a lower panel, characterized in that at least one of the panels includes at least one layer of resilient foam provided with through-holes as mentioned above. Said body may be of a number of different types, a spring body or made of polyurethane foam, an air or water body or of any other type on the market.

Suitably in the mattress, the upper and power panels are the same.

Typically the mattress body consists of at least one layer of cellular latex foam with recesses.

Advantageously the mattress characterizes in that said resilient foam layer provided with through-holes of said panels and said at least one layer of resilient foam provided with through-recesses of said body are made of resilient foam having the same physical and mixture characteristics.

Advantageously the mattress comprises at least a latex foam layer with through-recesses.

In a third aspect, the present invention relates to a method of manufacturing a panel for a mattress, said panel comprising a first and second fabric layer joined together along their edges and a padding material in between said two fabric layers, said material consisting of at least one layer of resilient foam provided with through-holes, said foam layer being quilted between said first and second fabric layers, said method comprising the step of manufacturing a resilient foam body between two substantially planar faces spaced apart at a predetermined distance, said resilient foam body being formed with recesses extending for at least one portion of said distance transversally to said two faces, said method being characterized by the steps of:

a) cutting a plurality of layers in said resilient foam body parallel to the surface of said faces in the portion where said recesses are, each of said plurality of resilient foam layers including through-holes;

b) sandwiching padding material including at least one of said layers provided with through-holes in each panel between said first and second fabric layers.

Preferably the method is further characterized by the steps of:

c) continuously feeding a first fabric sheet;

d) associating together in succession and side by side said plurality of resilient foam layers with through-holes to said first fabric sheet and forming a group comprising said first fabric sheet and said plurality of layers;

e) winding up in concentric coils that group;

f) continuously feeding the unwinding coils of said group towards a predetermined stitching station;

g) continuously superimposing a second fabric sheet to the resilient foam layers with through-holes of said group;

h) quilting said resilient foam layers with through-holes to said first and second fabric sheets and forming a continuous element for mattress panels.

Conveniently, when put into practice, the method comprises the steps of:

forming a block of resilient foam including at least a first lower foam layer with recesses to obtain the mattress body and a second upper resilient foam layer with recesses to be used in padding mattress panels;

cutting a plurality of single layers along horizontal planes in said second upper resilient foam layer with recesses, each of said plurality of single resilient foam layers including through-holes;

sandwiching at least one of said single layers with through-holes in each panel between said first and second fabric layers.

Preferably the method comprises the step of preparing mixtures different from one another to constitute said lower resilient foam layer with recesses and said upper resilient foam layer with recesses.

Typically the method comprises the step of moulding the recesses of said upper foam layer with a decreasing section from top to bottom, for example, in a conical shape with its vertex inwards the foam.

Still preferably, the method provides the step of manufacturing said resilient block using latex foam.

The present invention will be now described in details with reference to the accompanying drawings, which are only to be considered as illustrative and not restrictive, where:

DETAILED DESCRIPTION OF THE INVENTION

Figure 1:
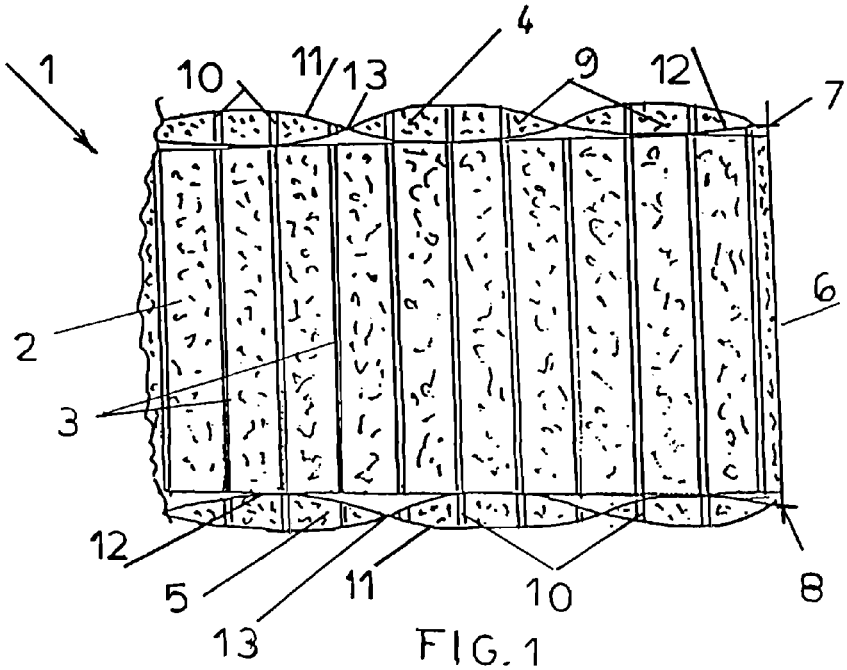
FIG. 1 is a partial longitudinal section of a cellular latex foam mattress sandwiched between two quilted panels.

FIG. 1 shows a mattress 1 made up of a latex foam body 2 comprising through-recesses 3 sandwiched between two upper and lower quilted panels, respectively 4 and 5, each being an aspect of the present invention, as discussed herein below.

The two panels 4, 5 are joined together by a peripheral band of fabric 6 stitched at the ends 7, 8 of each panel side.

In the most preferred exemplary description, panels 4, 5 are manufactured in the same way, therefore panel 5 has the same numerical reference as panel 4.

As it is apparent from FIG. 1, each panel advantageously offers the highest transpiration thanks to the novel presence of at least one latex foam layer 9 provided with several through-holes 10.

The latex foam layer 9 lies between two fabrics 11, 12 and made to adhere to them by means of quilting in different locations 13.

In order to ensure high transpiration, the through-holes 10 in the latex foam layer may be densely configurated. In particular the number of through-holes protruding on to the two outer surfaces of layer 9 may be dozens of through-holes/$dm^2$, for example up to 60-80 through-holes/$dm^2$, their diameters ranging from 1 to 30 mm, preferably between 8 and 24 mm.

In practice, it should be noted that the whole mattress is manufactured using high transpiration materials throughout its thickness, including panels provided with cellular latex foam panels with through holes and fabrics which are naturally highly permeable to air, as well as a body 2 with densely distributed recesses 3. Recesses 3 distribution in the body 2 may be the same as or different from that of the through-holes 10 in the layer 9.

In the example described here above, the recesses in the body 2 and the through-holes 10 in the layer 9 have the same distribution, moreover recesses 3 in the body 2 are aligned with the through-holes 10 in the layers of the two panels 4, 5.

Therefore the present invention allows to provide panels 4, 5 whose maximum transpiration substantially equals that of the body 2 of the mattress 1.

In an alternative embodiment of the mattress, a first panel may consist of a latex foam padding provided with through-holes and a second panel having conventional padding, comprising layers of cotton batting and/or compact foam.

In a second alternative, one of the two panels in a same kind of mattress, may have a ratio of thickness 0.5:1 between the resilient foam layer 9 and the total thickness of the whole padding material between the fabric layers 11, 12.

The above mentioned thickness values are taken at the maximum height of layer 9 between two stitchings at location 13.

The panel manufactured according to the above mentioned alternatives shows lower transpiration than that described in the embodiment shown in FIG. 1 but still higher than the panels having the padding of the prior art consisting of cotton batting layers and/or thick stuffing throughout the panel thickness.

Once again referring to the above mentioned example, the body 2 of the mattress 1 and the layer 9 of the two panels 4, 5 may be made of resilient foam having the same mixture characteristics.

A latex foam having a density between 35 and 150 $Kg/m^3$ and an ultimate elongation between 50 and 300 have proved to be suitable for the body 2 and the layer 9.

The mattress in FIG. 1 may be manufactured following different methods starting from a first step allowing to manufacture the block making up the body 2 of latex foam with recesses 3 and then a second step for the production of panels 4, 5 and finally the assembling of the body 2 with panels 4, 5.

In an embodiment, the body made up of latex foam 2 bearing recesses 3 may be manufactured in a single, ordinary mould consisting of a mould-hollow and respective cover.

However, as explained hereafter, it proved convenient—in view of the achievable advantages—to adopt a continuous moulding method to manufacture the resilient foam body of the mattress.

Figure 2:
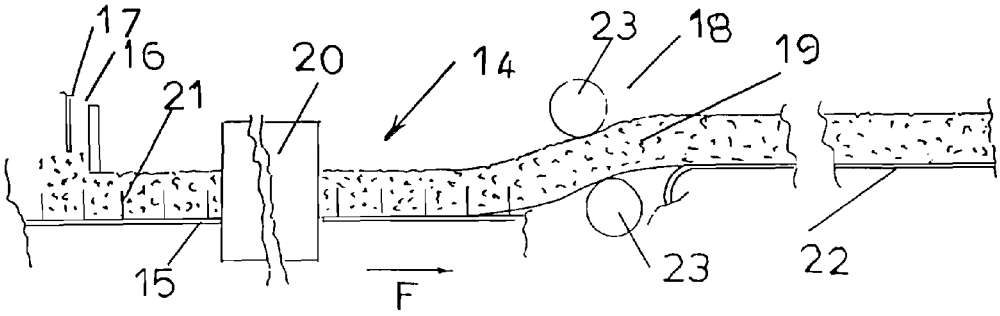
FIG. 2 is a schematic sectional view of a known type plant for continuously manufacturing the body of the cellular latex foam mattress.
Figure 3:
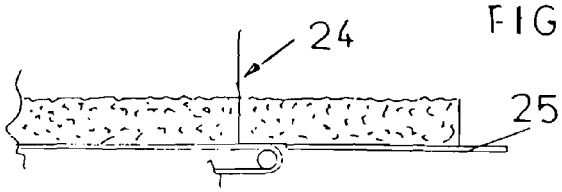
FIG. 3 is an extension of the plant of FIG. 2.

Such a continuous method uses the plant 14 depicted in FIGS. 2, 3.

Figure 4:
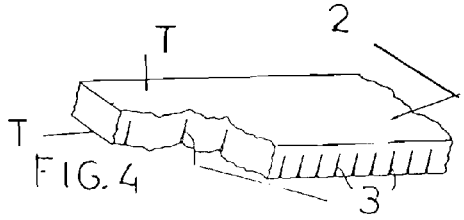
FIG. 4 is a partial perspective view of the body of the latex foam mattress manufactured using the plant shown in FIGS. 2 and 3.

The body 2 of the mattress 1 manufactured using plant 1 is illustrated in FIG. 4.

This body has two parallel faces T at a predetermined distance from each other.

As it is clearly visible from FIG. 4, a plurality of recesses 3 extends over a portion of the body 2, transversally to the two faces.

The plant 14 comprises a first laying member 15 continuously moving in the direction shown by arrow F, between a first station 16, where a suitable device 17 injects the latex foam material, and a second station 18 where a vulcanised latex layer 19 is removed; the layer 19 has been vulcanised, while passing through the tunnel member 20, located between stations 16, 18.

Preferably the tunnel member 20 provides the gelling and vulcanising means; to that end the tunnel member 20 is divided into a first gelling chamber and a successive second vulcanising chamber.

The tunnel is heated by suitable heating means, preferably hot carrier fluids and still more preferably flowing vapour.

The laying member 15 includes a plurality of metal protrusions 21 destined to mould the recesses 3. (FIG. 4).

The first laying member 15 can be of a variety of types, a continuous rotary belt moving between two pulleys (not shown) or in the form of adjacent plates connected to two chains moving around said two pulleys or by means of laying planes of trucks following an annular configuration.

According to a preferred embodiment, it is provided a laying member 15 comprising trucks moving along two branches connected by arcs of a circle, respectively an upper branch where the trucks contact one another and a lower branch where the trucks are spaced apart, are fewer than the upper ones and move at a higher speed than the trucks of the upper branch.

As the preferred embodiment of the trolleys and their handling along the two branches is fully described in EP Patent 0 995 144, for the sake of simplicity, description thereof is omitted.

Going back to the description of plant 14, a further stretch 22 of a belt or a similar handling system is provided to follow the laying member 15.

Such stretch 22 is continuously moved by means of independent operation means whose description has been omitted as being of an ordinary type.

Between the laying member 15 and the stretch 22 a pair of rollers 23 is provided. They rotate in opposite directions so as to draw the continuous foam layer 19 passing in between and move such layer from the laying member 15 to stretch 22.

The handling of stretch 22 drives the continuous foam layer 19 to a first cutting station 24 to form single mattress bodies made by successive cuts transversal to the advancing direction of the foam layer 19.

At the end of the cycle, the single body 2 lies on to the surface of the unloading station 25.

The method described so far is already known.

The method for manufacturing the novel mattress panels whose body 2 has been manufactured making use of the plant shown in FIGS. 2 and 3 will now be described.

For the sake of a simpler description, it must be pointed out that unlike what depicted in FIG. 4 where the body 2 has a foam thickness on top of the recesses, a body 2 of the mattress 1 provided with through-recesses 3 will be discussed herein after.

Figure 5:
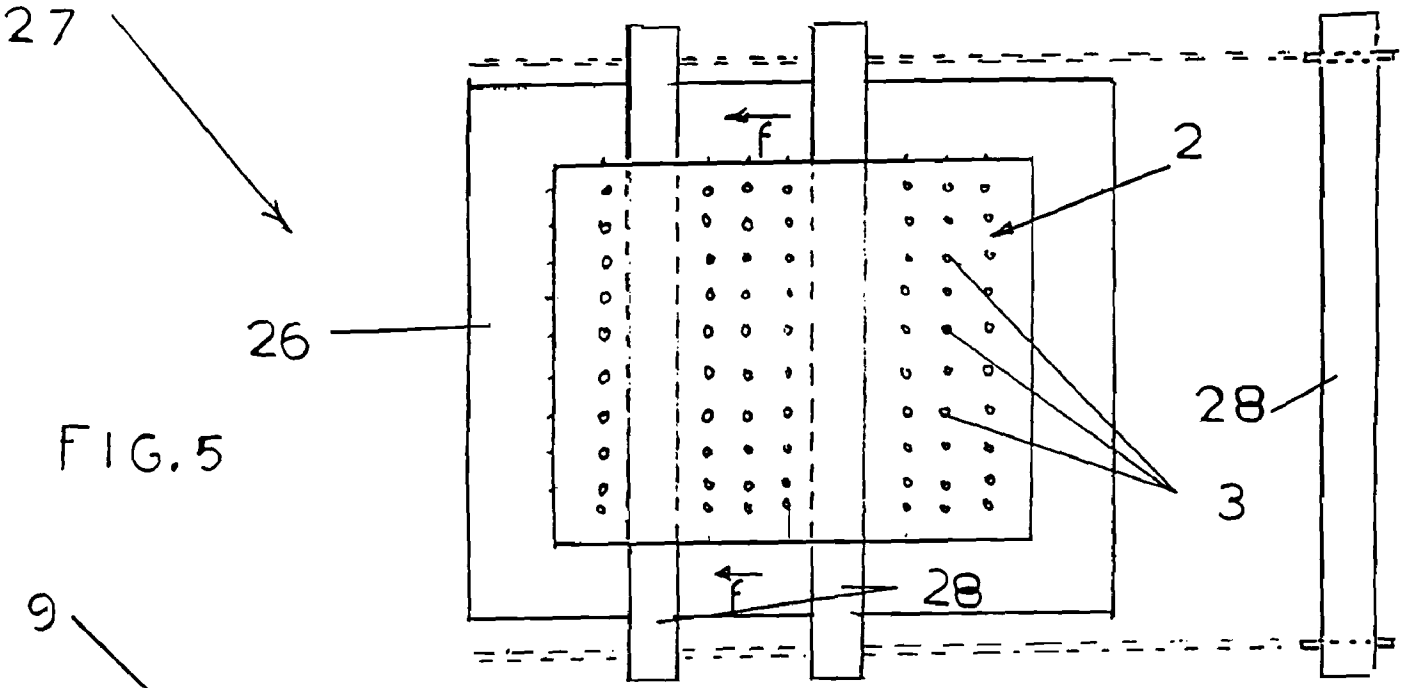
FIG. 5 is a top view of the device used for cutting the horizontal layers of a latex foam mattress.
Figure 6:
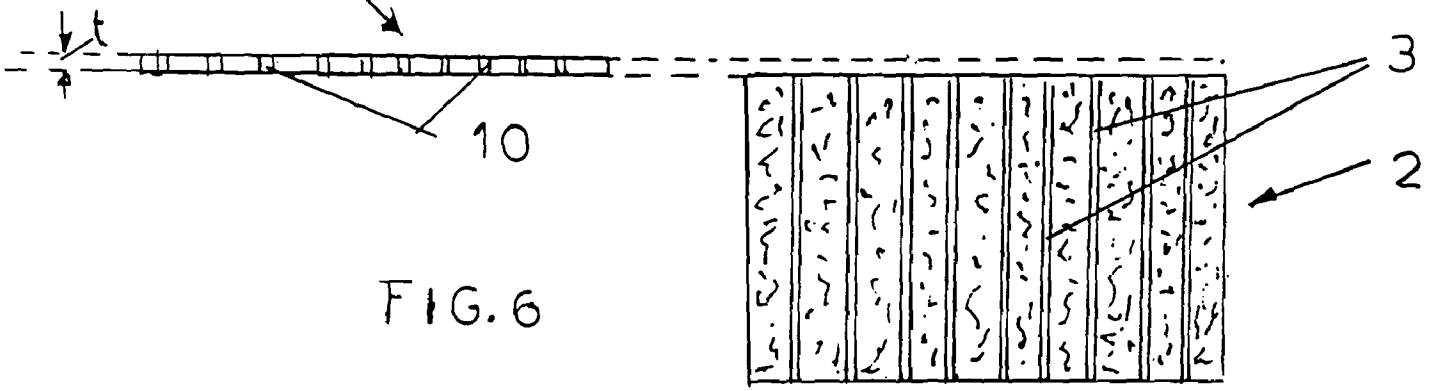
FIG. 6 is a partial sectional view of the mattress body after the horizontal layer has been cut.

We are now back to the final position of the plant shown in FIG. 3, specifically at the unloading station 25 where the body 2 including a latex foam portion 19 is. The panel manufacturing method is performed by the steps of:

carrying the latex foam body 2 from the loading station 25 to the horizontal plane 26 of a second cutting station 27 performing cuts parallel to the horizontal plane 26 (FIG. 5); here the body 2 will be cut up in a plurality of single parallel latex foam layers 9 with through-holes;

moving a cutting blade 28 parallel to the horizontal plane 26 from a rest position to the subsequent cutting operations, shown with dashed lines in the direction of arrow f;

cutting the body 2 at a predetermined thickness value "t" using blade 28 and obtaining a first single latex foam layer 9 bearing through-holes 10 (FIG. 6);

Preferably such thickness "t" should be in the range between 10 and 40 mm, even more preferably between 15 and 35 mm.

The cutting operations of the blade 28 will be successively repeated until a plurality of single latex foam layers 9 bearing through-holes 10 is provided.

The panel manufacturing method further proceeds with the operations of assembling a first fabric sheet on several latex foam layers 9 bearing through-holes 10, forming a first group of one panel, of assembling such first group with an overhanging second fabric sheet and of implementing a continuous quilted band for panels.

Figures 7, 8:
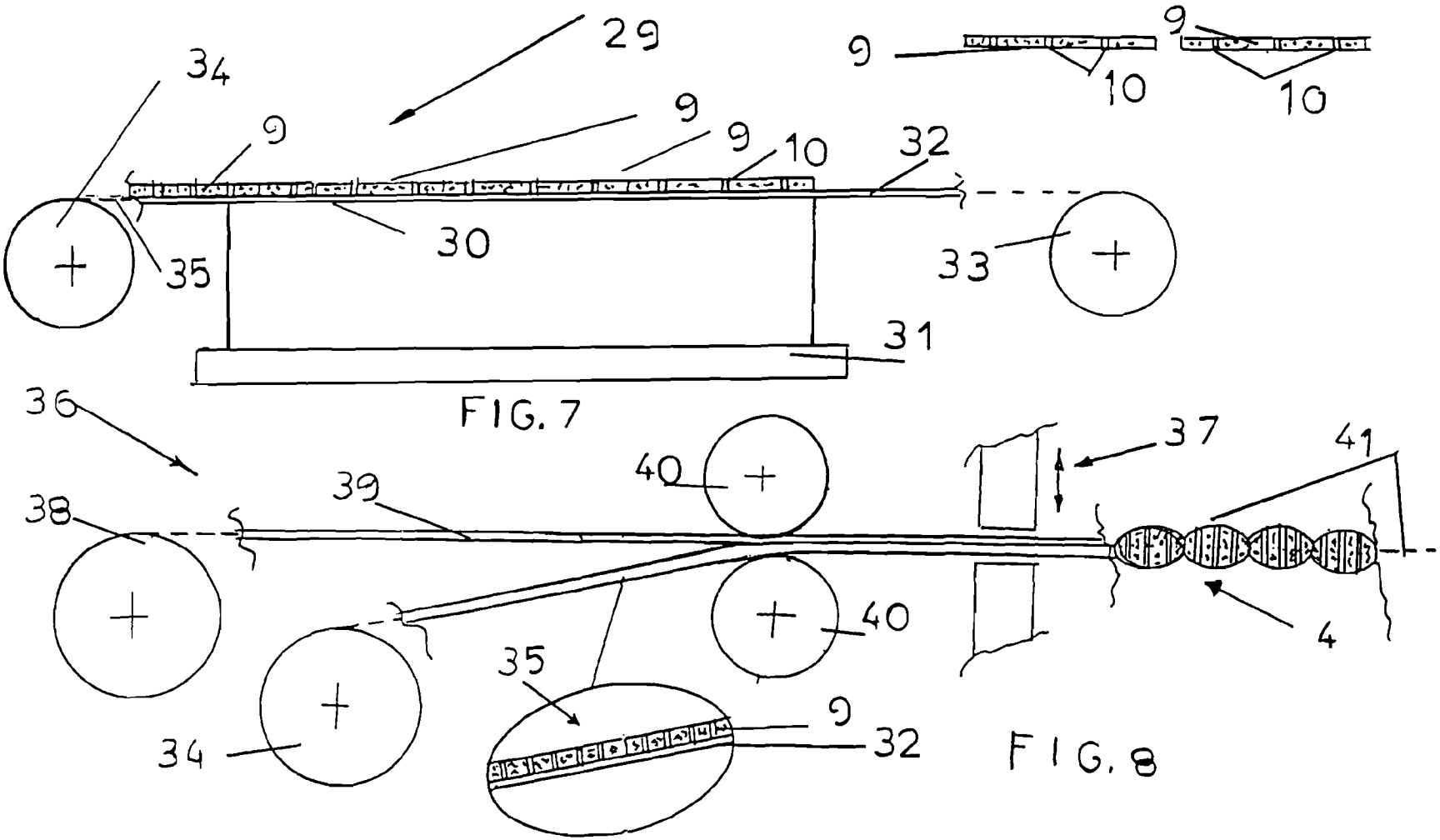
FIG. 7 is a longitudinal view of the device used for associating multiple layers of resilient foam with through-holes to a continuous fabric sheet.
FIG. 8 shows the device for quilting the resilient foam layer with through-holes between two sheets of fabric in order to obtain two quilted panels for mattresses.

In details the above method proceeds with the steps of:

transferring the plurality of single latex foam layers 9 with through-holes 10 from the second cutting station 27 to a first assembly station 29 (FIG. 7);

continuously advancing, along a planar surface 30 of a specially provided table 31 a first fabric sheet 32, preferably an unwoven fabric, unwound from a loading bobbin 33 and wound on a winding-on bobbin 34;

associating to said first continuous fabric sheet 32, side by side, preferably by gluing, said plurality of latex foam layers 9 with through-holes 10 thus forming a continuous assembling group 35 comprising said first continuous fabric sheet 32 and said plurality of layers 9 with through-holes 10;

winding up in concentric coils said first group 35 on the winding-on bobbin 34;

transferring said winding-on bobbin 34 near a second assembling station 36 (FIG. 8) including a stitching device 37 well-known on the market;

continuously feeding the coils unwound by said first group 35 from the winding-on bobbin 34 towards said second station 36 following the direction of the stitching device 37;

continuously unwinding from a second winding-on bobbin 38 a second fabric sheet 39 and directing said second continuous fabric 39 towards the stitching device 37;

continuously superimposing said second fabric sheet 39 on the latex foam layers 9 of said first group 35 while passing through rollers 40 each rotating in an opposite direction;

quilting said latex foam layers 9 with through-holes 10 onto said first and second fabric layers 32, 39 while passing through the stitching station 37, thus forming a continuous band 41 for mattress panels;

cutting said continuous band 41 into preferred sizes in order to provide a sequence of first mattress panels 4;

repeating the previous steps to form a sequence of mattress panels 5.

The next steps allowing to assemble the two panels 4, 5 to the body 2 of the mattress 2 and to stitch the peripheral band 6 are performed following well-known techniques, therefore they will be omitted for the sake of simplicity.

In order to explain how it was possible to overcome the problems and appreciate the advantages related to the invention, the following considerations should be taken into account.

At first the main idea was the maximum possible transpiration which could be found in a mattress body; therefore the body of a spring mattress was the first thing that came into mind.

In this case there is no difficulty as to the passing of the air but the free space allowed by the springs could not be transferred into a similar pattern for a quilted panel.

Consequently mattresses having a resilient foam body with recesses through which air may easily flow were taken into consideration.

Therefore an attempt has been that of applying such a solution to the padding material of a panel.

However in this case no solution appeared to be feasible.

As a matter of fact the body of the cellular latex foam mattress must necessarily have a high thickness, between 10 and 20 cm, and even more; this because the metal protrusions used in the moulding of the recesses must extend height-wise in order to transmit vulcanisation heat in an even and homogeneous way all over the cellular mass to be chemically stabilized to avoid having a poor product.

In other words, it is not possible to mould cellular latex foam bodies with recesses when adopting protrusions of few centimeters. In practice conventional techniques providing moulds and continuous methods using protrusions to mould foam products with very thin recesses suitable for filling a panel proved to be inadequate.

Therefore it did not appear obvious to take advantage of the good transpiration of a cellular latex foam body and then adopt it to the padding material of a panel.

The idea then was that it might be possible—somehow—to cut up a body having a considerably thick cellular latex foam with recesses and to adapt it to thickness values which might be suitable for a panel.

However, once again, signs were found out which were unfavourable to proceed as thought as it meant destroying or somehow adapting a body of a considerably thick mattress in order to obtain a product meant for a different use.

Moreover it was believed that adapting the body of the cellular foam mattress with recesses having high thickness in view of obtaining much smaller thickness would require special and quite expensive equipment.

In fact it should be noted that a latex foam mixture is an aqueous dispersion in which a great quantity of water absorbs the latex particles.

For example if the total amount of the latex foam mixture is 100 parts in weight, the amount of the dry-part is 60 parts in weight and the amount of water is 40 parts in weight.

Even though the amount of water in the different manufacturing steps of the body 2 is gradually decreasing, the weights involved are undoubtedly considerable.

What mentioned above is however understandable when referring to the body of a single latex foam mattress having a surface of 80 cm by 190 cm and a height of 20 cm and more, and when reference is made to bodies of double mattresses having a surface of 180 cm by 200 cm and a height between 20 and 30 cm; all of which having densities that may reach hundreds of grams/liter.

Therefore it turned out that it was impossible to find a solution to the problem owing to the fact that it did not seen wise to destroy the blocks of resilient foam meant for the manufacturing of mattress bodies and also because of the considerable sizes and weights of such blocks envisaging possible cutting operations.

Afterwards observing some rejections related to the bodies of latex foam mattresses bearing faults which did not involve the whole mass, the idea was that their substantially integral parts might be used, as well as the cutting of the block without affecting the ordinary production of cellular foam bodies.

Furthermore it was perceived that it might be possible to cut the blocks in a quite simple way taking advantage of the fact that such heavy blocks facilitated the manufacture and/or the employment of un-expensive equipment.

In practice it was considered that the above mentioned blocks, just because of their weight and size, might allow the use of a simple cutting blade driven along horizontal planes of the block without having to use other retaining devices on the block.

Eventually having perceived the possibility of experimenting the suitability of the foam block in order to obtain padding material for the panels, the final solution started to be followed by using both rejection blocks which might be cut into layers having no faults and integral blocks meant for the manufacturing of mattress bodies.

Going back to the operative steps of the method, it should be noted that during the cutting operation, the body 2 stays firmly on plane 26 in an unchanged position (FIG. 5) withstanding the tangential cutting thrusts even without balancing pressures on the upper surface of the body 2.

Advantageously the blade 28 is able to cut a latex foam layer 9 having a uniform thickness all over, ensuring a correct geometrical configuration of through-holes 10. Favourably such a step of horizontal cutting is performed considering the initial geometry of the cell distribution 3 wherefrom through-holes 10 of the layer 9 originate.

A further way to perform the method of obtaining quilted panels for mattresses and mattresses thereof is described here after.

Figures 9, 10, 11:
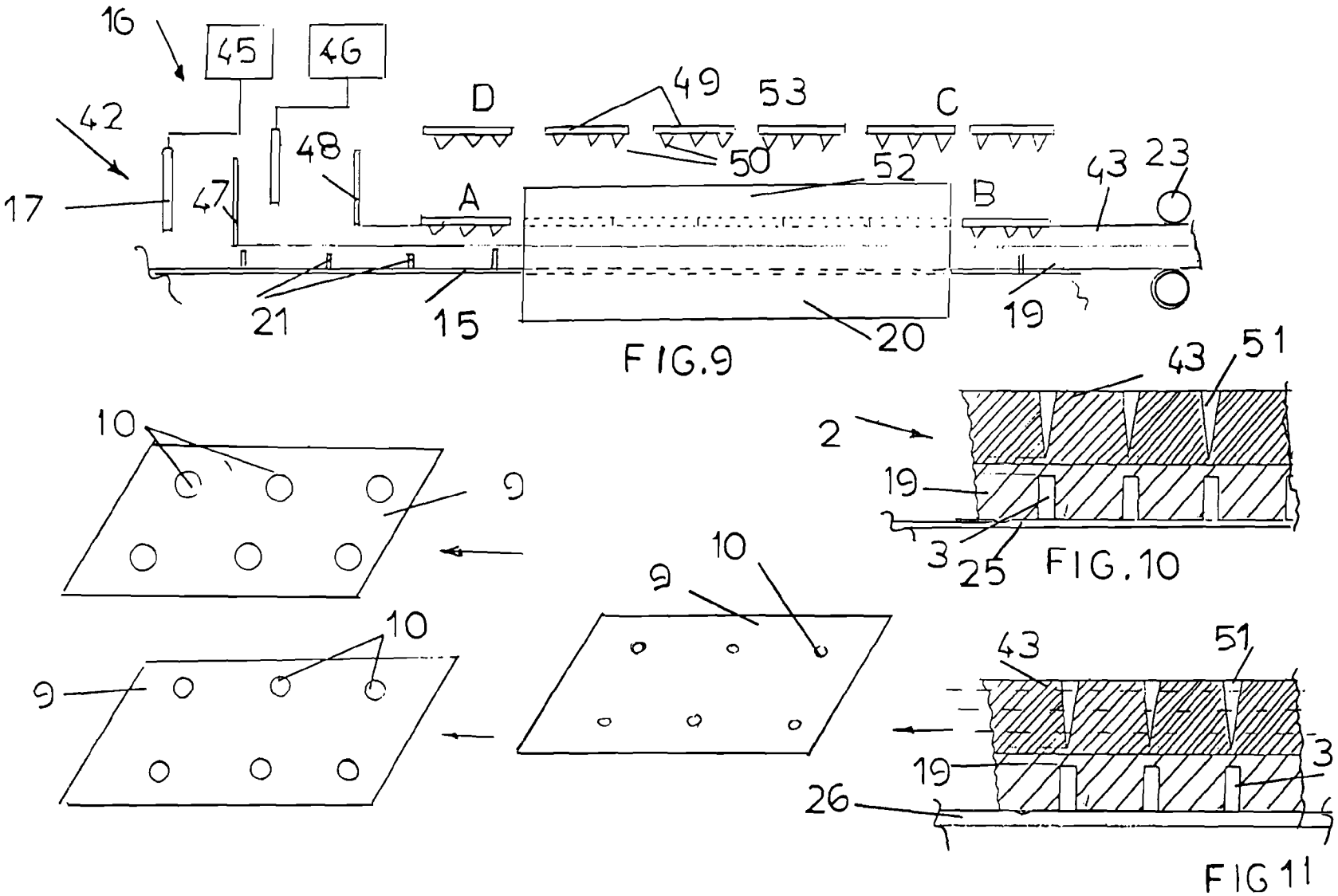
FIG. 9 is a schematic longitudinal view of a plant for continuously manufacturing a foam block to form both a mattress body and foam layers for mattress panels.
FIG. 10 is a partial longitudinal section of the block obtained using the plant shown in FIG. 9.
FIG. 11 shows the block of FIG. 10 and the cutting of single layers in the block upper portion.

The description makes use of the plant shown in FIG. 9 where the elements performing the same function as those in FIGS. 2 and 3 have the same numerical references. In FIG. 9, number 42 refers to a plant for continuously manufacturing a latex foam block 2, consisting of at least two latex foam layers—respectively (FIG. 10) the first 19, or basic block layer 2, whose lower surface is in contact with the laying surface 15 provided with protrusions 21 to obtain recesses 3, the second 43 having the inner surface touching the outer surface of the first layer 19.

The plant 1 includes gelling and vulcanisation means. Near the first station 16 a first device for the injection and laying 17 of a first basic mixture of latex foam, which will make up the first base layer 19, is located and spaced apart from the first station a second device for the injection and laying 44 of a second mixture of latex foam, which will make up the second layer 43, is located.

Said laying devices 17 and 44 move transversally to the feeding direction of the laying surface 15.

The laying devices 17 and 44 are connected to their own latex mixers consisting of a number of tanks and equipment including control-feeding, supplying and connecting equipment.

For the sake of a short description, said mixers have been referred to with two tanks 45, 46 only provided with suitable pipes connecting them to the laying devices 17, 44 wherefrom the two latex foam mixtures flow out.

The plant comprises two doctor blades 47, 48 for the two latex foam mixtures.

The plant makes use of a plurality of metal members 49 provided with protrusions 50 jerking out of the base and bound towards the bottom to make the upper recesses 51 on the second layer.

Such protrusions 50, shown in the exemplary description, have a conical shape with their vertex downwardly directed for the reason which will be explained further on.

Such members 50 are applied in a continuous sequence on to the outer surface of the second layer going through the first gelling chamber as well as the second vulcanising chamber in which vapour reaches a temperature of about 100° C.

The members 50 preferably have a planar configuration and are made of aluminium; they move along two substantially horizontal lengths, an active length 52 and an inactive rest length 53.

In the inactive rest length plates 50 collected at B, downstream the tunnel device 20 are positioned at C before being driven back to the inlet A of the tunnel device.

The plurality of plates 50 is moved along the ABCD configuration shown in FIG. 9 by suitable operation means.

It is worth mentioning here that such operation means may include mechanical or pneumatic drives for vertical lifting and lowering as well as conveyor belts in the upper length CD.

To operate the plant, a first natural rubber latex and a second latex made, for example, from synthetic rubber—such as a butadiene styrene polymer and the respective components of the two latexes are prepared separately, being subject to mixing by mechanical mixing means.

The components include surfactants, vulcanising agents like sulphur and accelerators, antioxidizers to prevent ageing of the finished-product, fillers, oils, stabilizers.

Before being added to the latex, the components are turned into an aqueous dispersion by special mechanical means in order to reduce the particle sizes.

The two dispersion media are added to the aqueous dispersion in the respective tanks 45, 46 where suitable blade rotors are turned on so as to ensure a homogeneous dispersion of the materials.

In a further step, hereafter called foaming step, pressurized air is supplied inside the two tanks so as to obtain two latex foam mixtures.

Foaming is achieved by pressurized air and mechanical mixing.

The foam density is controlled by varying the ratio between air amount and latex flow rate.

The method is carried out using two different mixtures as the respective materials may have different chemical properties.

Further one or more process parameters may be chosen to achieve a different cellular structure in the two mixtures.

Preferably the method provides two latex from mixtures with different densities.

By adopting such a feature, a latex block 2 is initially obtained, comprising the mattress body consisting of the lower layer 19 with recesses 3 and a portion of foam consisting of the upper layer 43 with recesses 51.

The upper foam portion 43 will perform a plurality of single foam layers with through-recesses which can be used as padding material for a number of mattress panels.

To this end, the whole foam block 2 is driven from the unloading station 25 (FIG. 10) to the cutting device 27 (FIG. 5) where the horizontal cutting of single latex foam layers 9 bearing through-holes 10 is carried out on the upper portion 43.

As clearly seen in FIG. 11, the method advantageously allows to manufacture padding layers 9 for quilted panels provided with through-holes 10 having the initial geometrical configuration of protrusions 50.

It is thus possible to select the degree of transpiration required for a specific mattress panel considering the predetermined diameters of the through-holes.

Particularly, the method allows to meet different requirements connected with the making of a quilted panel.

In fact it is possible to obtain the same mixture density of the first and second tanks 45, 46 (FIG. 9) so that the quilted panel is homogeneous with the mattress body 19 or even to have a mixture density of the second tank 46 which results different from that of the first tank 45 in order to differentiate the performances of the quilted panel from those of the mattress body.

The difference in density is achieved, for example, by providing, in the first tank 45, an amount of air smaller than the latex while in the second tank an amount of air higher than the latex.

According to a particular embodiment of the method it is envisageable to add to the latex contained in the second tank 46—together with other components—also single or multiple batches of materials resulting more suitable to a quilted panel meant for the mattress body.

The panel manufacturing method is then carried out as already described with reference to FIGS. 7 and 8.

The invention claimed is:

1. A method of manufacturing a panel for a mattress, said panel comprising a first fabric layer and a second fabric layer joined together along their edges and a padding material in between said two fabric layers, said padding material comprising at least one layer of resilient foam provided with through-holes, said at least one foam layer being quilted between said first and second fabric layers, said method comprising:

manufacturing a resilient foam body between two parallel faces at a predetermined distance from each other, said resilient foam body being formed with recesses extending for at least a portion of said distance transversally to said two faces, said method further comprising:

a) cutting a plurality of single resilient foam layers in said resilient foam body parallel to said faces, where said recesses extend for said at least one portion of said distance, each of said plurality of single resilient foam layers bearing through-holes;

b) sandwiching the padding material including at least one of said single resilient foam layers bearing through-holes in each panel between said first and second fabric layers and quilting said sandwiched at least one foam layer to said first and second fabric sheets to make said at least one foam layer adhere to the first and second fabric layers.

2. A method according to claim 1, wherein the ratio between the thickness "s" of said resilient foam layer bearing through-holes and the total thickness "S" of said padding material between said fabric layers ranges from 0.5 to 1.

3. A method according to claim 1, wherein said at least one resilient foam layer with through-holes is a latex foam.

4. A method according to claim 3, wherein at least one latex foam layer has a density between 35 and 150 $Kg/m^3$.

5. A method according to claim 3, wherein said one latex foam layer is cut as single layer in a moulded cellular latex foam body with recesses.

6. A method according to claim 1, wherein said at least one resilient foam layer includes from 6 to 84 through-holes/$dm^2$.

7. A method according to claim 1, wherein said at least one resilient foam layer comprises through-holes having a diameter of 1-30 mm.

8. A method according to claim 1, further comprising forming a mattress by steps comprising sandwiching a body between an upper panel and a lower panel, wherein at least one of the panels is said panel for a mattress comprising: the first and second fabric layers joined together along their edges and the padding material between said fabric layers.

9. A method according to claim 8, wherein said upper panel and said lower panel are the same.

10. A method according to claim 8, wherein said body comprises at least a resilient foam layer with recesses.

11. A method according to claim 10, wherein said at least one resilient foam layer bearing through-holes of said panels and said at least one layer of resilient foam with recesses of said body are made of a resilient foam having the same physical and mixture characteristics.

12. A method according to claim 11, wherein said recesses of said body are through-recesses.

13. A method according to claim 10, wherein said resilient foam of said body is a latex foam.

14. A method according to claim 1, further comprising:

c) continuously feeding a first fabric sheet along a surface;

d) attaching said plurality of single resilient foam layers with through-holes to said first fabric sheet fed on the surface by laying said foam layers arranged end to end in series onto said first fabric sheet to form a group comprising said first fabric sheet and said plurality of layers;

e) winding up said group into at least one concentric coil;

i) continuously unwinding said group from said at least one coil and feeding the unwound group towards a stitching station;

j) continuously superimposing a second fabric sheet onto the unwound resilient foam layers of said group;

k) quilting said resilient foam layers bearing through-holes to said first and second fabric sheets at the stitching station to make the unwound resilient foam layers adhere to the first and second fabric layers to form a continuous band for panels of mattresses.

15. A method of claim 14, wherein the the first and second fabric layers joined together along their edges and the padding material is between said fabrics, said padding material consisting of at least the layer of resilient foam provided with through-holes, said foam layer being quilted between said first and second fabric layers;

wherein prior to coiling the layers are attached to the first fabric sheet by gluing.

16. A method according to claim 15, wherein said at least one resilient foam layer comprises through-holes having a diameter between 8 and 24 mm.

17. A method for manufacturing quilted panels for mattresses according to claim 1, wherein the method comprises:

forming the block of resilient foam to include at least a first lower foam layer with recesses to obtain the mattress body and a second upper resilient foam layer with recesses to be used in padding mattress panels;

cutting the plurality of single layers along horizontal planes in said second resilient foam layer with recesses, each of said plurality of single resilient foam layers including through-holes;

sandwiching at least one of said single layers bearing through-holes in each panel between said first and second fabric layers.

18. A method according to claim 17, comprising preparing mixtures different from one another to constitute said lower resilient foam layer bearing recesses and said upper resilient foam layer with recesses.

19. The method according to claim 17, wherein the recesses of said lower resilient foam layer are molded with a decreasing section from top to bottom.

* * * * *